United States Patent [19]

Stana et al.

[11] 4,311,675

[45] Jan. 19, 1982

[54] MAINTAINING REDUCTIVE STRIP EFFICIENCY IN URANIUM RECOVERY PROCESSES

[75] Inventors: Regis R. Stana, Lakeland, Fla.; Edward Mitchell, Pittsburgh; Joseph S. Rudolph, North Huntingdon, both of Pa.; José G. López, Lakeland, Fla.

[73] Assignee: Westinghouse Electric Corp., Pittsburgh, Pa.

[21] Appl. No.: 114,466

[22] Filed: Jan. 23, 1980

[51] Int. Cl.[3] ..... B01D 11/04

[52] U.S. Cl. ..... 423/8; 423/10

[58] Field of Search ..... 423/8, 10, 18

[56] References Cited

U.S. PATENT DOCUMENTS

| | | | |
|---|---|---|---|
| 2,849,277 | 8/1958 | Thomas | 423/8 |
| 3,528,797 | 9/1970 | Funk et al. | 71/39 |
| 3,711,591 | 1/1973 | Hurst et al. | 423/10 |
| 3,737,513 | 6/1973 | Wiewiorowski et al. | 423/8 |
| 3,980,750 | 9/1976 | Cousinou et al. | 423/9 |

OTHER PUBLICATIONS

Long, Ed., *Engineering for Nuclear Fuel Reprocessing*, Gordon & Breach, New York, (1967), pp. 172–174.

Kerns; B. A., "Chemical Suppression of Nitrogen Oxides", *I & EC Proc. Des. & Dev.*, vol. 4, No. 3, (1965), pp. 263–265.

Hurst et al., "Solvent Extraction of Uranium from Wet-Process Phosphoric Acid", ORNL-TM-2522, (1969).

Ferguson et al., "Chemical Technology Division Annual Progress Report", ORNL-4572, (1970), pp. 185–186.

*Primary Examiner*—Deborah L. Kyle

*Attorney, Agent, or Firm*—A. Mich, Jr.

[57] ABSTRACT

Wet process phosphoric acid is oxidized with nitric acid so that uranium values therein are in the +6 state. The organic extractant which contacts the acid extracts the +6 uranium and nitrate and/or nitrite ions. Urea is added to the oxidized acid to react with the nitrate and/or nitrite ions so that the organic does not extract them. The organic is reductively stripped with an aqueous solution containing ferrous ions. The efficacy of the ferrous ions is not lost through reaction with nitrate and/or nitrite ions.

4 Claims, 1 Drawing Figure

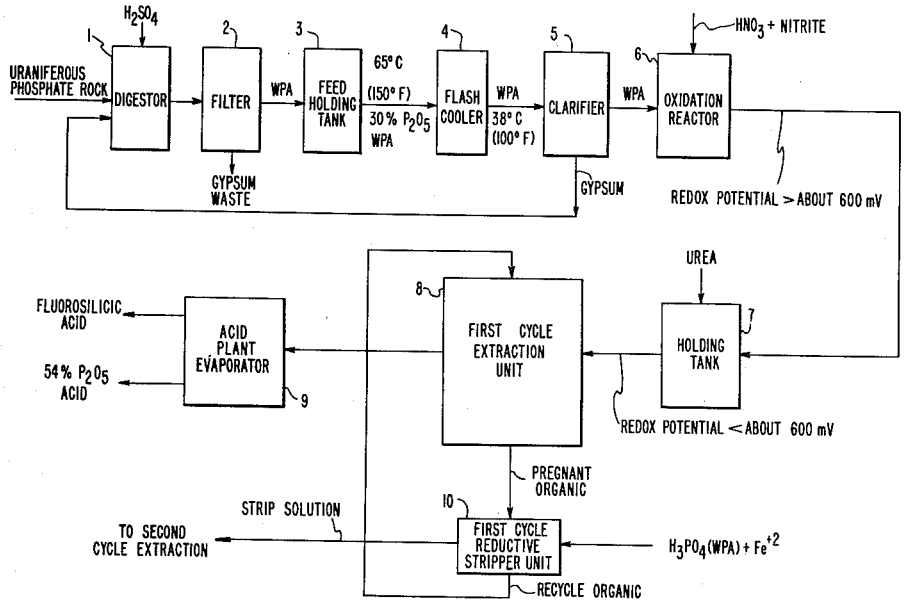

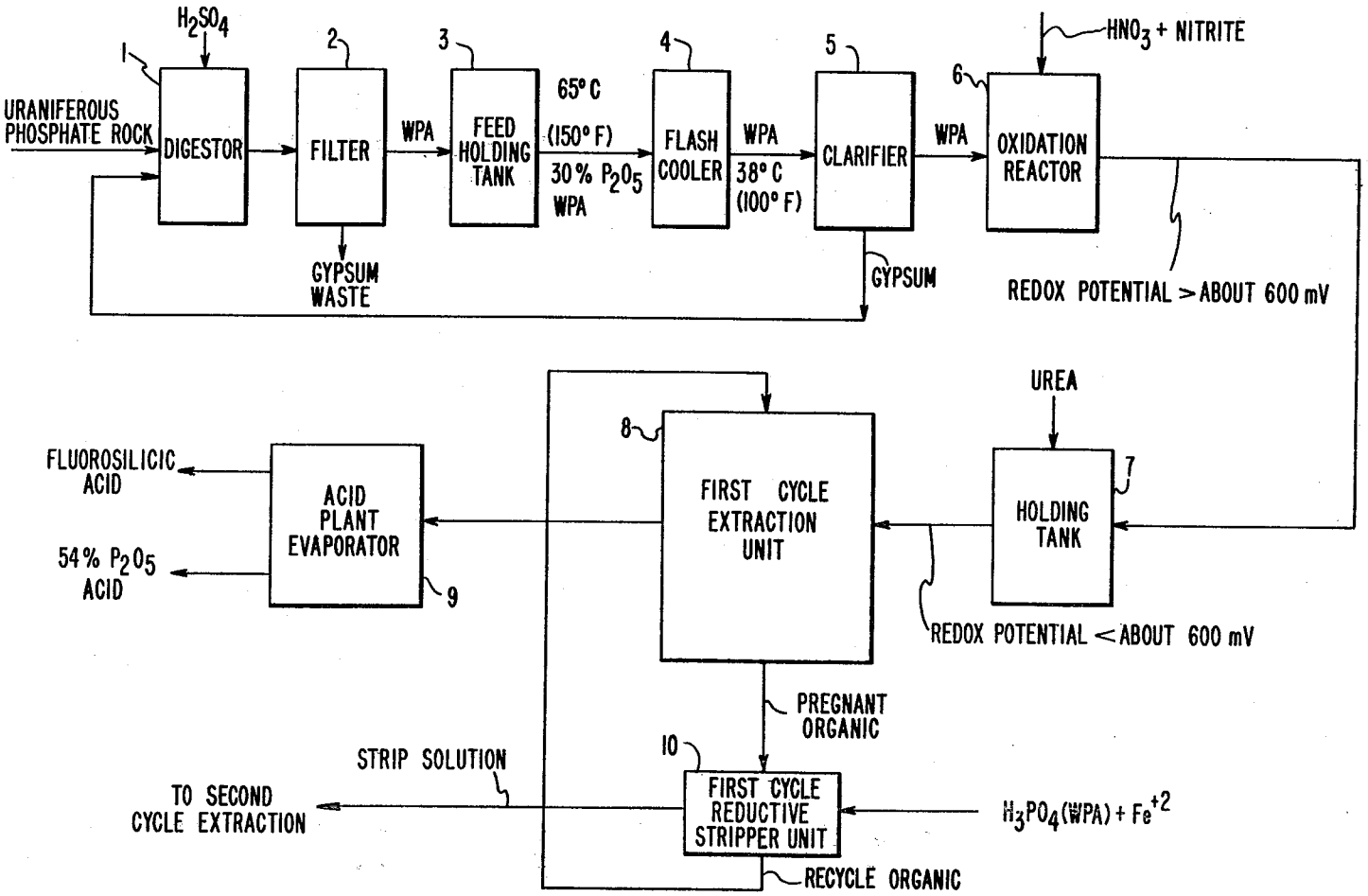
URANIFEROUS PHOSPHATE ROCK
$H_2SO_4$
1
DIGESTOR
2
FILTER
GYPSUM WASTE
WPA
3
FEED HOLDING TANK
65° C (150° F)
30 % $P_2O_5$ WPA
4
FLASH COOLER
WPA
38° C (100° F)
5
CLARIFIER
GYPSUM
WPA
6
OXIDATION REACTOR
$HNO_3$ + NITRITE
REDOX POTENTIAL > ABOUT 600 mV
UREA
7
HOLDING TANK
REDOX POTENTIAL < ABOUT 600 mV
8
FIRST CYCLE EXTRACTION UNIT
PREGNANT ORGANIC
9
ACID PLANT EVAPORATOR
FLUOROSILICIC ACID
54 % $P_2O_5$ ACID
$H_3PO_4$(WPA) + $Fe^{+2}$
10
FIRST CYCLE REDUCTIVE STRIPPER UNIT
RECYCLE ORGANIC
STRIP SOLUTION
TO SECOND CYCLE EXTRACTION

MAINTAINING REDUCTIVE STRIP EFFICIENCY IN URANIUM RECOVERY PROCESSES

BACKGROUND OF THE INVENTION

One method of recovering the uranium values present in phosphate fertilizer deposits involves the oxidation of the uranium values that are present in wet process phosphoric acid streams and the extraction of the oxidized uranium from the acid into an immiscible organic extractant. Organic extractants which effectively extract the oxidized uranium ($U^{+6}$) are known in the art and contain a combination of dialkyl phosphoric acid and trialkyl phosphor oxide. An example of such an extractant is a liquid hydrocarbon diluent containing di(2-ethylhexyl) phosphoric acid (D2EHPA) and trioctylphosphine oxide (TOPO). One such process for uranium recovery from wet process phosphoric acid (WPA) is reported in detail in ORNL-TM-2522, (a U.S. A.E.C. report) entitled "Solvent Extraction of Uranium from Wet-Process Acid" by F. J. Hurst et al.

An effective method of subsequently stripping the uranium from the organic extractant involves the use of an aqueous phosphoric acid solution containing ferrous ions. The aqueous raffinate (a phosphoric acid solution) from the first cycle is a suitable stripping solution provided it contains ferrous ion to effect the reduction of the uranium $U+6$ to $U^{+4}$ during the stripping operation, i.e., during the mixing of the aqueous strip and pregnant organic phases. An effective such reductive stripping operation is reported in detail in ORNL TM-4572 a U.S. A.E.C. Chemical Technology Div. Progress Report at pages 185 and 186 (October 1970).

Various oxidzing agents may be considered to first oxidize the uranium to the +6 state uranyl ion ($UO_2+2$) with various attendant advantages and disadvantages. Nitric acid is considered to be a particularly suitable oxidant. Relatively inexpensive, it will rapidly oxidize the wet process acid (which may be indicated by measuring the Redox potential) to provide rapid efficient extraction into the organic containing D2EHPA-TOPO. Theoretical explanations of nitric acid oxidation reactions in general suggest that oxidation may proceed because of the presence and generation of nitrite ion ($NO_2-$). A process incorporating the use of nitric acid and nitrite to oxidize wet process acid prior to first cycle extraction is considered to be generally advantageous.

We have found that the organic phase which extracts the oxidized uranium also has an affinity for and therefore extracts both nitrates and nitrites that may persist as contaminants in the nitric acid oxidized wet process acid. We have also found that the presence of these nitrates or nitrites in the extractant reduces the effectiveness of the subsequent reductive stripping operation. Apparently, the nitrates and/or nitrites react with the ferrous ion in the aqueous strip solution. The effectiveness of the reductive stripping operation is reduced because of the apparent reduced availability of ferrous ion to reduce the oxidized uranium during the stripping operation. The ferrous ion acts as a driving force in the stripping operation. Increasing the concentration of the ferrous ion by the increment that reacts with the contaminating nitrate-nitrite ions is a way of restoring the efficacy of the stripping operation but it also causes the ultimate uranium product to be more highly contaminated with the added excess iron. Maintaining the effectiveness or efficiency of the reductive strip without the subsequent iron contamination would, of course, be desirable.

PRIOR ART

U.S. Pat. No. 3,528,797 discloses the suppression of evolution of nitrogen oxides by urea.

B. A. Kearns in "Chemical Suppression of Nitrogen Oxides" pages 263–265, Vol. 4, No. 3, July 1965, I&EC Process Design and Development describes the destruction of nitrite ion by urea in a nitric acid metal pickling process.

ENGINEERING FOR NUCLEAR FUEL REPROCESSING,

Justin T. Long (Ed.), 1967 at page 173 describes reactions beieved to represent nitric acid oxidation of uranium in another aqueous media.

U.S. Pat. No. 3,980,750 discloses the extraction of uranium and agents for removing nitrites.

U.S. Pat. No. 2,849,277 discloses the oxidation of ferrous ion in nitric acid solutions.

U.S. Pat. No. 3,711,591 discloses a reductive stripping process with solutions containing ferrous ion.

U.S. Pat. No. 3,737,513 discloses stripping with a phosphoric solution containing ferrous ions and discloses nitric acid as an oxidant prior in a second cycle extraction.

SUMMARY OF THE INVENTION

It is an object of this invention to maintain the effectiveness of the reductive stripping of oxidized $U+6$ uranium from a pregnant organic where the organic has in earlier stages extracted the uranium from a phosphoric acid solution that has been oxidized with nitric acid. The efficacy of the stripping depends upon the concentration of the reductant, for example, ferrous ion, that is available in the aqueous solution during the stripping operation. The addition of urea to the phosphoric acid solution after the nitric acid oxidation but before the extraction step prevents the unwanted extraction and carry-over of nitrate and/or nitrite ions into the organic. Since those ions are not substantially carried over or extracted by the organic, they do not with or otherwise inhibit the effectiveness of the ferrous ion in the phosphoric acid strip solution.

BRIEF DESCRIPTION OF THE DRAWING

The FIGURE is a schematic block diagram illustrating a process for recovering uranium from wet process acid and including a method for maintaining the efficacy of the ferrous ion in reductive stripping.

DESCRIPTION OF PREFERRED EMBODIMENTS

Referring now to the FIGURE, a Florida uraniferous phosphate rock and sulfuric acid are fed to digestor 1 in a typical phosphoric acid plant. The wet process phosphoric acid and gypsum product is passed through an acid plant filter 2 to remove gypsum waste. The acid is directed to a feed holding tank 3, then metered to flash cooler 4. Clarifier 5 removes additional gypsum and provides a clarified wet process acid (WPA) which goes to oxidation reactor 6. Nitric acid and, advantageously, substantial amounts of nitrite ion as a reaction initiator are added to the wet process acid in reactor 6. The nitric acid oxidized wet process acid coming out of reactor 6 should have a Redox potential more than about 600 mV., indicating that the uranium has been oxidized to its +6 extractable state. Prior to passing into the multi-stage solvent extraction unit 8, urea is added to the oxidized wet process acid in tank 7 in sufficient quantity to lower the Redox potential to less than about 600 mV to react with the contaminating nitrate and/or nitrite ions. The uranium remains in the oxidized +6 extractable state and is efficiently extracted into the 0.5 M. D2EHPA-0.125 M. TOPO-hydrocarbon (AMSCO 450) organic. The nitrate and nitrite ions are not substantially extracted into the organic, having been either destroyed by the urea or converted into relatively non-extractable forms.

The wet process acid from the extraction unit 8 is returned to acid plant evaporator 9 for concentration to a 54% $P_2O_5$ acid and recovery of fluorosilicilic acid. The pregnant organic is directed to the multi-stage reductive stripper unit 10 where it contacts a reductive aqueous phosphoric acid strip solution containing about 25 g/l of ferrous ion. The uranium is transferred into the strip solution and is directed to a second cycle extraction, while the organic is recycled to the extraction unit. These latter steps are described in detail, for example, in U.S. Pat. No. 3,711,591, Nitric acid may also be conveniently employed as the oxidant in the second cycle. The efficacy of the ferrous ion in the reductive stripping operation of the first cycle is maintained because the addition of urea destroys the otherwise adverse effect of nitrates and/or nitrites on the ferrous ion in the stripper.

With a continuous 700 gpm flow of clarified, cooled wet process acid into a 15,000 gallon oxidation reactor 6, about 1 gpm of 50% nitric acid and if necessary, a nitrite, is fed into the reactor to maintain a Redox potential of about 600 mV. for the oxidized acid exiting the reactor. About 3 pounds of urea per minute (as a water solution) is added to 15,000 gallon tank 7, before the solvent extraction takes place. That will be sufficient to permit the later occurring reductive strip to continue with no significant loss in the efficacy of the ferrous ion. During the initiation of oxidation or the rapid recovery of a last oxidation large additions of nitric acid and nitrite compounds may provide substantially higher concentrations of nitrate and nitrite ions. Addition of more urea could be advantageous during such excursions.

Tests were conducted to determine the relationship between the nitric acid oxidant dose rate and the Fe+2 consumed in the strip acid and means to reduce the consumption. The initial tests were conducted in non-blanketed glassware as shakeouts. In these tests, 500 ml. of acid oxidized with various quantities of nitric acid was contacted with 100 ml. of solvent. This O/A ratio was chosen to load the solvent with uranium and nitrate/nitrite approximately to the same point as that expected in a commercial plant. This loaded solvent was then contacted with 10 ml. of strip acid for 15 minutes, and the iron two (Fe+2) content measured before and after the contact. Table 1 gives the results of these tests. The initial tests show that the iron two consumed (oxidized) in the strip acid is related to the total nitric used for oxidation. Tests 6–11 show that addition of urea to the feed acid prior to extraction will reduce the iron two consumption by two-thirds. The final two tests, conducted with nitrogen sparging, again shows the effectiveness of urea addition to the feed acid. For the last two tests, extraction coefficients of 2.3 and 2.7 (for urea treated acid) were obtained, indicating that the urea is reducing the nitrite/nitrate only, and not the uranium.

Table 2 shows the concentration of nitrogen (measurement of nitrate/nitrite) in the solvent contact with oxidized acids containing various quantities of urea. As can be seen, the urea greatly reduces the quantity of nitrate/nitrites extracted by the solvent but is not itself substantially extracted.

TABLE 1

Iron Two Consumptions in Strip Acid
All Contacts at 43° C.

| Test | Nitric Acid Dose lb/1000 gal | $Fe^{+2}$ Consumed in Strip Acid g/l | Oxidized Acid Pretreatment |
|---|---|---|---|
| 1 | 0 | 7.7–8.4 | None |
| 2 | 6.85 | 17.4 | None |
| 3 | 10.9 | 21.3–24.7 | None |
| 4 | 16.6 | 33.6–35.8 | None |
| 5 | 33.2 | 35.3–36.4 | None |
| 6 | 8.2 | 8.9 | 0.24 g/l Urea Added (2 lb/1000 gal) Redox Pot = 575 |
| 7 | 8.2 | 8.9 | 0.5 g/l Urea Added Redox Pot = 545 |
| 8 | 8.2 | 7.2 | 1.0 g/l Urea Added Redox Pot = 545 |
| 9 | 8.2 | 22.4 | None Redox Pot = 825 |
| 10 | 16.4 | 14.1 | 1.0 g/l Urea Added Redox Pot = 598 |
| 11 | 16.4 | 36.3 | None Redox Pot = 850 |
| 12 | 8.2 | 6.7 ($N_2$ Sparge) | None Redox Pot = 825 |
| 13 | 8.2 | 3.3 ($N_2$ Sparge) | 0.3 g/l Urea Added Redox Pot = 550 |

TABLE 2

Nitrogen Picked Up By Solvent From Phosphoric Acid Containing Nitric Acid And Urea

| Test | Nitric Acid Dose lb/1000 gal | Urea Added bl/1000 gal | Nitrogen In Solvent mg/ml |
|---|---|---|---|
| 1 | 11.7 | 0 | 88 |
| 2 | 11.7 | 4.17 | 21 |
| 3 | 11.7 | 8.34 | 39 |
| 4 | 11.7 | 16.68 | 25 |
| 5 | 0* | 8.34 | <11 |

*C.P. grade acid was used for this test, Wet process phosphoric acid was used for all other tests.

As to the use of Redox potential to indicate the oxidation of wet process acid with nitric acid and the reaction of urea with nitrate and/or nitrite ions, it should be understood that the Redox potential is quite unstable around 600 mV and that there is a hysteresis effect that has been observed. If the wet process acid is oxidized so that a Redox potential even a small increment above about 600 mV is observed or measured, one can be confident that the uranium will be in the desired oxidized +6 state. Indeed, if the Redox potential were measured again at a later time, it would be substantially above 600 mV. Again, going in the reverse direction, the same phenomenon has been observed. Thus, if sufficient urea is added to the oxidized acid so that a Redox potential with even a small increment below about 600 mV is observed or measured, one can be confident that the uranium will remain in the +6 state and that the nitrate and/or nitrite ions will not interfere with the reductive stripping which will follow the oxidative extraction.

It should be noted that the organic extractant itself (i.e. the D2EHPA-TOPO in a diluent) is not adversely affected by the nitric acid oxidation of the acid and the resulting nitrate and nitrite ions that are present. The urea is not added to preclude a problem in the step immediately following the oxidation (i.e. the extraction step) but rather the one following the extraction step (i.e. the reductive stripping with ferrous ion solutions). Even relatively minor additions of urea which would leave unreacted nitrate and/or nitrite ions would thus be advantageous because more of the ferrous ion would be effective in the stripping operation that with no addition of urea. An excess of urea does not appear to have any adverse effect on the purpose, except for the unnecessary cost.

We claim:

1. A method of maintaining the efficacy of ferrous ion in the reductive stripping of uranyl ions from an organic extractant wherein said organic has contacted a wet process phosphoric acid that has been oxidized with nitric acid and nitrite ions, the method comprising the step of adding urea to said oxidized phosphoric acid before the organic contacts the phosphoric acid.

2. In a method of recovering uranium from wet process phosphoric acid wherein: (1) the phosphoric acid is oxidized with nitric acid to provide uranyl ions in the acid and thereby contaminating the acid with nitrate and/or nitrite ions; (2) the oxidized phosphoric acid is contacted with an organic extractant to extract the uranyl ions into the organic; and (3) the organic is contacted with an aqueous stripping solution containing ferrous ion to strip the uranium from the organic into the stripping solution, the improvement comprising adding urea to the phosphoric acid after the oxidation to react with nitrate and/or nitrite ions therein.

3. A method of recovering uranium from wet process phosphoric acid comprising the steps of (1) contacting the acid with nitric acid to oxidize the uranium to its +6 state, thereby contaminating the acid with nitrate and/or nitrite ions; (2) adding urea to react with at least a portion of the contaminating ions in the acid; (3) contacting the acid with an immiscible liquid organic to extract the oxidized uranium thereinto; and (4) contacting the organic containing said uranium with an aqueous stripping solution containing dissolved reductant ferrous ions.

4. The method of claim 3 wherein the dissolved reductant ions comprise ferrous ions.

* * * * *